US005275713A

United States Patent [19]

Hradcovsky

[11] Patent Number: 5,275,713

[45] Date of Patent: Jan. 4, 1994

[54] METHOD OF COATING ALUMINUM WITH ALKALI METAL MOLYBDENATE-ALKALI METAL SILICATE OR ALKALI METAL TUNGSTENATE-ALKALI METAL SILICATE AND ELECTROYLTIC SOLUTIONS THEREFOR

[76] Inventor: Rudolf Hradcovsky, 27 W. Beach St., Long Beach, N.Y. 11561

[21] Appl. No.: 717,006

[22] Filed: Jun. 18, 1991

Related U.S. Application Data

[63] Continuation-in-part of Ser. No. 561,336, Jul. 31, 1990, abandoned.

[51] Int. Cl.[5] ..... C25D 11/00; C25D 11/02

[52] U.S. Cl. ..... 205/106; 205/321; 205/322; 205/323; 205/324; 205/325

[58] Field of Search ..... 204/561; 205/106, 321, 205/322, 323, 324, 325

[56] References Cited

U.S. PATENT DOCUMENTS 4,082,626 4/1978 Hradcovsky ..... 204/56.1
4,659,440 4/1987 Hradcovsky ..... 204/58

OTHER PUBLICATIONS

A. Kenneth Graham, Electroplating Engineering Handbook, Second Edition, Reinhold Publishing Corp., New York, 1962, p. 55.

*Primary Examiner*—John Niebling
*Assistant Examiner*—William T. Leader

[57] ABSTRACT

Method for coating a rectifier metal (aluminum) with alkali metal molybdenate/alkali metal silicate or alkali metal tungstenate/alkali metal silicate comprises immersing a rectifier metal (anode) and a cathodic metal in an electrolytic solution and imposing voltage potential between the two electrodes. The voltage is first raised to about 240 to about 260 volts during an oxidation stage, and thereafter to about 380–420 volts to form the desired coating.

Unique electrolytic solutions are provided for the electrodeposition method.

14 Claims, 1 Drawing Sheet

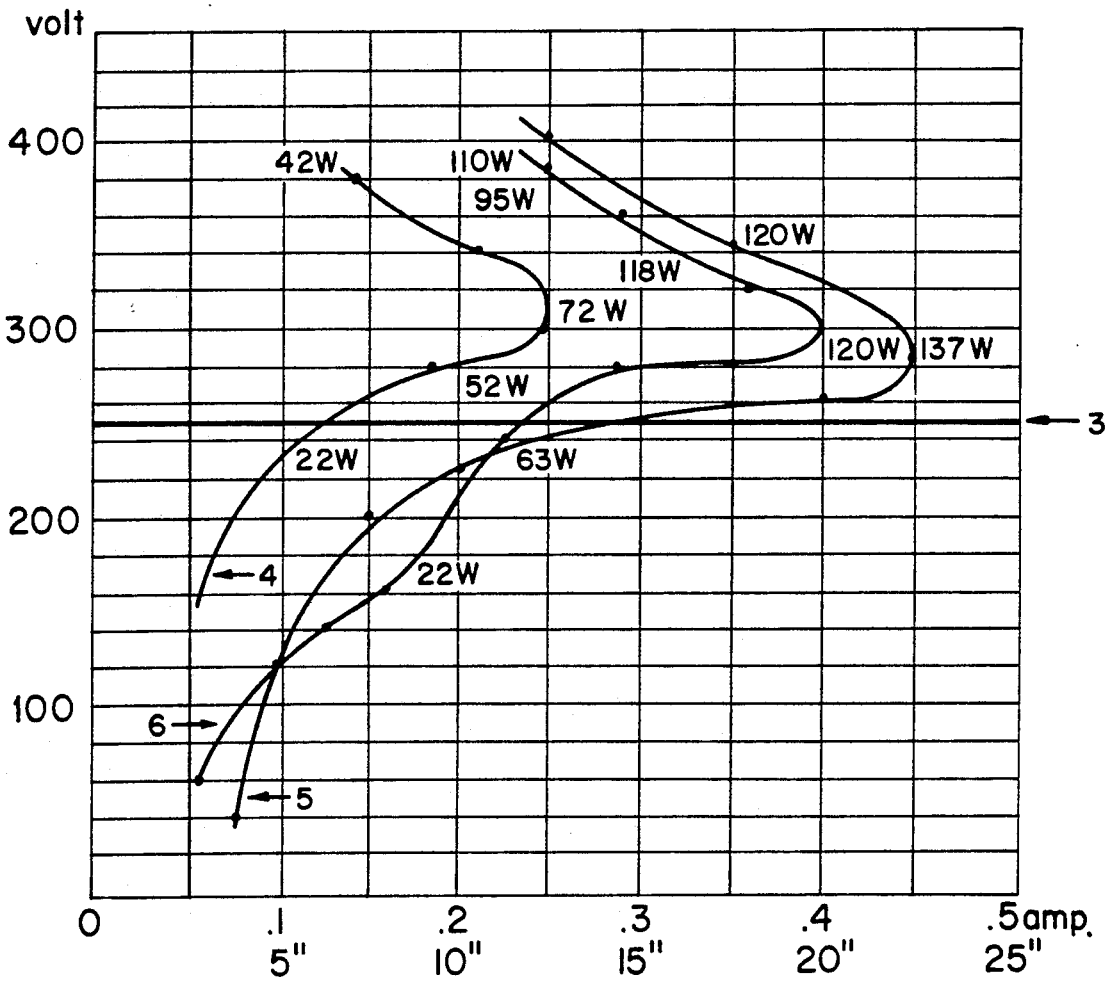
volt
400
300
200
100
0
.1
5"
.2
10"
.3
15"
.4
20"
.5amp.
25"
42W
110W
95W
120W
118W
72 W
120W
137 W
52 W
22W
63W
22W
3
4
5
6

METHOD OF COATING ALUMINUM WITH ALKALI METAL MOLYBDENATE-ALKALI METAL SILICATE OR ALKALI METAL TUNGSTENATE-ALKALI METAL SILICATE AND ELECTROYLTIC SOLUTIONS THEREFOR

RELATED APPLICATION

This application is a continuation-in-part of application Ser. No. 07/561,336, filed Jul. 31, 1990, now abandoned.

FIELD OF THE INVENTION

This invention relates to an electrolytic method of coating rectifier metals, notably aluminum and its alloys, with alkali metal molybdenate-alkali metal silicate or alkali metal tungstenate-alkali metal silicate, and is particularly related to a method whereby the metal is coated with an adherent, hard, smooth, uniform and corrosion resistant layer of such coatings. The invention also relates to electrolytic baths for providing such coatings and the coated articles resulting therefrom.

BACKGROUND OF THE INVENTION

Aluminum and its alloys have been widely used in a variety of industrial and household applications in sheet forms or as strips, bars, rods, tubes, structural members, household appliances and utensils, hardware and a host of other articles. As mentioned in the U.S. Pat. No. 2,941,930, there are numerous other outlets for aluminum articles and its alloys for such uses as ornamental wall panels for inside or outside of various structures, restaurant furnishings, art objects and several other applications.

Because of its low density and tendency toward corrosion, it is necessary to provide aluminum articles with a suitable coating in order to impart structural strength and integrity thereto and to protect them against corrosion and environmental degradation. In the past, the metal surfaces were often painted or enameled in order to protect them against the action of the elements. However, painting and enameling do not provide the metal surfaces with satisfactory protection because they are basically organic coatings and tend to degrade at elevated temperatures. Moreover, these coatings usually adhere poorly to the metal surfaces, particularly when subjected to different temperature cycles.

In order to provide improved protection for aluminum and its alloys, the metal surfaces have been anodized using various electrolytic solutions. While anodization of aluminum affords the surface of the metal greater protection against corrosion than has hitherto been obtained by painting or enameling, still the resulting coated articles have not been entirely satisfactory because of inadequate resistance against corrosion by acids and alkalis. Moreover, the coatings imparted to the metal by known electrodeposition techniques often lack the desired degree of hardness, durability, smoothness, adherence to the metal surface and the imperviousness required to meet the ever-increasing industrial and household demands. Frequently, the coated aluminum articles have been unsatisfactory for use as decorative articles because of the poor quality or appearance of their surfaces.

There are numerous patents which deal with anodization of aluminum metal and its alloys. See, e.g. U.S. Pat. No. 4,659,440 and the patents cited therein. A review of the prior art patents illustrates the significant role of the electrolytic solution used in the anodizing process in order to provide aluminum and its alloys with the desired coatings. Thus, the nature and properties of the coatings formed on aluminum and its alloys depend, to a great extent, on the composition of the anodic bath (electrolytic solution). Other parameters such as the conditions used during the electrodeposition process also contribute to the nature and quality of the coating. These factors were recognized by the present inventor and discussed in his U.S. Pat. No. 4,082,626 and later in his aforementioned U.S. Pat. No. 4,659,440.

As described in said U.S. Pat. No. 4,082,626, a rectifier metal, (e.g., aluminum) is anodized in an electrolytic solution consisting of a relatively pure potassium silicate concentrations theretofore employed. The process comprised immersing the rectifier metal (anode) in the electrolytic solution, immersing a second metal in said solution, said second metal serving as the cathode, imposing a voltage potential across the anode and cathode and causing an electric current to flow therebetween until a visible spark is discharged at the surface of the rectifier metal, increasing the voltage potential to about 300 volts and maintaining this potential at approximately the same level until the desired coating thickness is deposited on the surface of the rectifier metal. While the resulting coating exhibits more desirable qualities than the coatings obtained by the prior art anodizing methods, they still do not fulfill the stringent demands of various industrial and household requirements. In addition, the surface finish of the metal is not entirely satisfactory for decorative applications of the coated metallic article.

In his later U.S. Pat. No. 5,659,440, the present inventor describes the use of a different electrolytic solution for anodizing aluminum and its alloys. It consists essentially of an aqueous solution containing an alkali metal silicate, a peroxide, a water-soluble carboxylic group-containing organic acid and a water-soluble fluoride. Where the coated article is intended to be used for decorative purposes, a small amount of a vanadium compound is included in the electrolytic solution in order to impart color to the resulting coating. The vanadium compounds used to impart the desired color to the coatings include sodium vanadate ($Na_3VO_4$), hypovanadate $[M_2(CV_4O_9]\cdot H_2O$, e.g., sodium pyrovanadate ($Na_2V_2O_7$) and potassium metavanadate ($KVO_3$), and vanadium fluorides such as vanadium trifluoride ($VF_3\cdot H_2$), vanadium tetrafluoride ($VF_3$) and vanadium pentafluoride ($VF_4$).

In the method described in the aforementioned U.S. Pat. No. 4,659,440, the aluminum article serving as the anode, and another metal serving as the cathode, are immersed in the electrolytic solution and a "voltage shock" is applied between these two electrodes. This voltage shock is quickly raised to about 300 volts within 2 to 10 seconds, and thereafter the voltage is raised gradually to about 450 volts within a few minutes until the desired coating thickness is formed. The coatings produced in accordance with the method described in said patent is more uniform, homogeneous and less pervious than the coatings produced by the method described in the earlier U.S. Pat. No. 4,082,626. In the latter patent the aluminum surface is coated with a pure silicate compound, i.e., sodium silicate or potassium silicate, whereas in the former patent the coating also includes some vanadium compound.

More recently, in his pending application Ser. No. 459,552, filed Jan. 2, 1990, now U.S. Pat. No. 5,069,763, the present inventor describes a method of coating aluminum with vanadium oxides. Also described therein is an electrolytic bath which comprises a mixture, in water, of a major amount of an alkali metal orthovanadate and a minor amount of an alkali metal silicate. The electrolytic solution may further include an alkali metal hydroxide, and sodium peroxide or potassium peroxide, to obtain a pH of about 12 to about 13.5. The resulting coating on the metal surface is adherent, hard, smooth, uniform, durable and corrosion resistant, and is predominantly alkali metal orthovanadate.

The disclosures of said patents and said application are fully incorporated herein by reference.

OBJECTS OF THE INVENTION

It is an object of this invention to protect the surface of rectifier metals, particularly aluminum and its alloys, against corrosion and attack by the elements.

It is also an object of this invention to provide aluminum and its alloys with an adherent, hard, smooth, uniform, impervious and corrosion-resistant coating.

It is a further object of this invention to provide such metals with a protective coating of alkali metal molybdenate-alkali metal silicate or alkali metal tungstenate-alkali metal silicate.

It is still an object of this invention to provide an electrolytic solution for coating aluminum and its alloys which solution is stable and can withstand the relatively high voltage potential applied during the electrodeposition method.

It is also an object of this invention to provide coated articles of aluminum or alloys of aluminum which are particularly well suited for various industrial, structural and household applications.

The foregoing and other objects and features of the present invention will be further described in, and more readily appreciated from the ensuing detailed description and the accompanying drawing.

SUMMARY OF THE INVENTION

The objects of the present invention are attained by an electrodeposition method whereby a rectifier metal (notably aluminum), serving as the anode, is immersed in a novel electrolytic solution, in which is also immersed another metal such as, e.g., iron, which acts as the cathode relative to the rectifier metal. A voltage potential is applied between the two electrodes, i.e., the anodic rectifier metal and the cathodic metal (iron) this causing a current to flow across said metals and also causing the oxidation of the anode. During this oxidation step the voltage rises to approximately 240–260 volts within several seconds, without sparking. Thereafter, the applied voltage is increased to about 380–420 volts within several minutes, with visible sparking between the electrodes to form the desired coating.

The composition of the electrolytic solution depends, to a degree, on whether it is desired to a coating of alkali metal molybdenate-alkali metal silicate or a coating of alkali metal tungstenate-alkali metal silicate. When it is intended to produce a molybdenate-silicate coating, the electrolytic solution contains an aqueous solution of hydrogen peroxide, the metal oxide (e.g., molybdenum oxide), hydrogen fluoride and potassium silicate and potassium hydroxide. If it is desired to produce a tungstenate-silicate coating, the electrolytic bath contains water, silicotungstic acid, potassium acetate, hydrogen fluoride, hydrogen peroxide, potassium silicate and potassium hydroxide.

The resulting coating of alkali metal molybdenate-alkali metal silicate (or alkali metal tungstenate-alkali metal silicate) is adherent, smooth, uniform and is resistant to corrosion and the elements.

BRIEF DESCRIPTION OF THE DRAWING

The single drawing in this application comprises three curves illustrating the advantages of the method of this invention and the electrolytic solutions employed herein.

DETAILED DESCRIPTION OF THE INVENTION

In accordance with the present invention, there is provided a novel electrolytic solution, which when used to electroplate rectifier metals, imparts a highly adherent, hard, smooth, uniform and corrosion resistant coating on the surface of the metal. The composition of the electrolytic solution varies somewhat depending on the desired coating on the rectifier metal. Thus, for example, the composition of the electrolytic solution used to coat the metal with molybdenate-silicate coating differs somewhat from the composition of the electrolytic solution used to coat the metal with tungstenate-silicate coating. In either case, however, the electrolytic solution must be in the form of a colloidal complex in order to achieve the desired coating quality characteristics.

The method of this invention can be employed to coat those metals which in the electrolytic bath used herein exhibit rectifying quality. The term "rectifier metal" therefore, denotes such metals which include aluminum, tantalum, magnesium and their alloys, and alloys of aluminum with zinc and copper, silicone, magnesium, and the like. In case of aluminum alloys, the aluminum predominates in the alloy, and hence, the term "aluminum" as used throughout this application is intended to denote not only aluminum but its alloys as well.

A. Preparation of the Electrolytic Solution

Regardless of the coating applied to the rectifier metal, the electrolytic solutions are generally prepared in the same manner. Thus, for example, if the rectifier metal is to be coated with molybdenate-silicate coating, the electrolytic solution is prepared by mixing, at ambient temperature and pressure, an aqueous hydrogen peroxide solution, molybdenum trioxide ($MoO_3$), hydrogen fluoride and a colloidal solution of alkali metal silicate. After mixing these ingredients, a precipitate or a gel is formed which is dissolved by the addition of an alkali metal hydroxide, preferably potassium hydroxide in an amount sufficient to clarify the precipitate, followed by dilution with water to obtain a 4 degree Baume colloidal complex solution having a pH of about 11.8.

Examples 1–3 below describe three different electrolytic solutions used for coating a rectifier metal with a molybdenate-silicate coating.

| Ingredient | Amount |
|---|---|
| Example 1 | |
| $H_2O_2$* | 50 cc |
| $MoO_3$ | 1 g |
| HF (1:20) | 1.5 g |

-continued

| Ingredient | Amount |
|---|---|
| $K_2SiO_3$, 30 degree Be | 75 cc |
| Example 2 | |
| $H_2O_2$* | 50 cc |
| $MoO_3$ | 2 g |
| HF (1:20) | 1 g |
| $K_2SiO_3$, 30 degree Be | 80 cc |
| Example 3 | |
| $H_2O_2$* | 50 cc |
| $MoO_3$ | 1.5 g |
| HF (1:20) | 2.0 g |
| $K_2SiO_3$, 30 degree Be | 100 cc |

*used as 3% aqueous solution

In all three examples, a precipate was initially formed after mixing all the ingredients. This precipitate was dissolved by adding potassium hydroxide (KOH) to clarify the precipitate, followed by dilution with water (to about 650 cc) thereby obtaining a 4 degrees Baume complex colloidal solution having a pH of approximately 11.8.

Examples 4–6 below illustrate the preparation of electrolytic solutions used for coating the rectifier metal with tungstenate-silicate. The method of preparation of these electrolytic solutions is basically similar to the method of Examples 1–3. It comprises initially mixing at ambient conditions, water, silicotungstic acid ($H_2SiW_{12}O_{40}:H_2O$), potassium acetate ($CH_3COOK$), hydrogen fluoride, hydrogen peroxide, granulated potassium hydroxide and alkali metal silicate. After mixing these ingredients, a precipitate is formed which is clarified by the addition of potassium hydroxide, followed by dilution with water to obtain a 4 degree Baume colloidal complex solution having a pH of approximately 11.8.

| Ingredient | Amount |
|---|---|
| Example 4 | |
| Water | 50 cc |
| $H_2SiW_{12}O_{40}H_2$ | 3 g |
| $CH_3COOK$ | 1.5 g |
| HF (1:20) | 1.5 g |
| $H_2O_2$* | 40 cc |
| KOH (granulated) | 1 g |
| $K_2SiO_3$, 30 degrees Be | 50 cc |
| Example 5 | |
| Water | 50 cc |
| $H_2SiW_{12}O_{40}H_2$ | 2 g |
| $CH_3COOK$ | 2 g |
| HF (1:20) | 1.5 g |
| $H_2O_2$* | 40 cc |
| KOH (granulated) | 1.5 g |
| $K_2SiO_3$, 30 degrees Be | 65 cc |
| Example 6 | |
| Water | 50 cc |
| $H_2SiW_{12}O_{40}H_2$ | 1.5 g |
| $CH_3COOK$ | 3 g |
| HF (1:20) | 2 g |
| $H_2O_2$* | 40 cc |
| KOH (granulated) | 2 g |
| $K_2SiO_3$, 30 degrees Be | 80 cc |

*used as 3% aqueous solution

In Examples 4–6, a precipitate was formed after initial mixing of ingredients. This precipitate was clarified by the addition of a small quantity of KOH, followed by dilution with water (to about 650 cc) thereby obtaining a 4 degree Baume complex colloidal solution having a pH of approximately 11.8.

It is essential that the electrolytic solution contain a colloid in order to produce the desired coating. The addition of colloid promotes and increased voltage sparking between the electrodes during the electrode position process. The higher the voltage, the quicker the coating is formed and the thicker is the resulting coating.

While potassium silicate is the colloid of choice other alkali metal silicates may also be used in lieu of, or together with the potassium silicate. These alkali metal silicates include sodium silicate, lithium silicate, and the like.

It is also important in the practice of the invention to use the colloid in particulate form. Generally, the average particle size of the silicate colloid may vary from about 30 to about 50 millimicrons, but is preferable about 30 millimicrons. This promotes sparking which is uniform over the entire anode and thus produces a smoother and more luminescent coating. If the size of the colloid particles substantially exceeds about 50 millimicrons, sparking on the anode becomes irregular and intense thus causing high reverse current which overheats the electrolytic bath and results in marked increase in the electric power consumption, hence increasing energy requirement and the cost of the operation.

Also, if desired another alkali metal acetate such as, for example, sodium acetate or lithium acetate may be used instead of potassium acetate.

B. The Electrolytic Method

In accordance with the method of this invention, the rectifier metal is immersed in a vessel containing the electrolytic solution, and a second electrolytically-insoluble metal such as iron or nickel is also immersed in the vessel. Thereafter a voltage is applied across the electrodes and this voltage is raised to about 240–260 volts within about 10 to about 60 seconds (depending on the nature of the electrolytic bath), during which the rectifier metal (e.g., aluminum) is oxidized. During the oxidation phase, the current between the electrodes increases depending on the nature of the electrolytic bath. Thereafter, the voltage is continuously raised to about 380–420 volts with visible sparking between the electrodes. During this phase of the electrolytic process, the current decreases and coagulation takes place upon the surface of the rectifier metal with the formation of a mixture of alkali metal molybdenate-alkali metal silicate, or alkali metal tungstenate-alkali metal silicate, as may be the case. Low reverse current during this stage causes minimal heating of the electrolytic bath.

Due to the inclusion of the alkali metal silicate colloid in the electrolytic solution, intense fine sparking is produced across the anode which results in the formation of a hard, smooth, adherent and corrosion resistant coating on the anode. Sparking usually continues for about 1 minute to about 20 minutes, preferably from about 7 to about 10 minutes, depending on the desired coating thickness.

The advantages of the present invention will now be illustrated with reference to the drawing wherein voltage is shown as a function of current and time.

The curve designated by the numeral 4 represents the energy (in watts, i.e., volts v. ampere) consumed in coating aluminum with potassium molybdenate-potassium silicate in an electrolytic solution having the composition described in Example 3.

The curve designated by the numeral 6 represents the energy consumption when coating aluminum with potassium tungstenate-potassium silicate preparation an electrolytic bath as in Example 6.

The curve designated by the numeral 5 represents the energy consumption when aluminum is coated with vanadium oxide by the electrolytic process described in application Ser. No. 459,552, filed Jan. 2, 1990, the disclosure of which is fully incorporated herein by reference.

The electrolytic process for obtaining the molybdenate-silicate coating and tungstenate-silicate coating (curves 4 and 6) were essentially as hereinbefore described.

As shown in the drawing, the energy consumption for the formation of molybdenate-silicate coating (curve no. 4, 72 watts) is considerably lower than the energy consumption for the formation of vanadium oxide (curve no. 5, 137 watts). Even when the electrolytic process of this invention is used to form tungstenate-silicate, the energy consumption is lower (curve no. 6, 122 watts) than for vanadium oxide coating (curve no. 5, 137 watts).

Referring again to the drawing, the heavy line 3 corresponds to 250 volts, which is the approximate voltage limit of the oxidation stage of the process. As noted from this drawing, lower current is consumed and less time is required during the oxidation stage of molybdenate-silicate coating (curve no. 4) than during oxidation stage of vanadium oxide coating (curve no. 5) or during the oxidation stage of tungstenate-silicate coating.

Also, lower reverse current is required for moldenate-silicate coating (curve no. 4) and tungstenate-silicate coating (curve no. 6) than for vanadium oxide coating (curve no. 5). Line 3 also represents the sparking time in minutes as a function of the voltage during the sparking (reduction-deposition) operation. As seen from these curves and line 3, the desired coating is usually formed within several minutes.

Thus, it can be seen that the novel electrolytic solutions used herein not only result in excellent protective coatings for aluminum but also provide for a more efficient and more economical process with less electrical energy consumption.

Aluminum and aluminum alloys coated with molybdenum silicate and tungsten silicate by the electrolytic method of this invention find widespread utility in such fields where anti-corrosivity is required. For example, they may be used as structural materials, for fabricating reaction vessels, fluid pipes and like handling corrosive materials and for numerous other parts and equipments.

While the invention has been described with a certain degree of particularly, it must be understood that several obvious changes and modifications can be made both in the electrolytic bath as well as the coating method. Such changes and modifications are nevertheless within the scope of the present invention.

What is claimed is:

1. A method of coating a rectifier metal selected from the group consisting of aluminum, tantalum, magnesium and mutual alloys thereof, and alloys of aluminum with copper or zinc, to produce hard, smooth, adherent, uniform and corrosion-resistant coating of molybdenum silicate, said method comprising:

(a) immersing said rectifier metal in an electrolytic bath comprising water, hydrogen peroxide, hydrogen fluoride, molybdenum oxide and alkali metal silicate, (b) immersing a second metal in said electrolytic bath, said second metal being cathodic relative to said rectifier metal when a voltage is applied between said metals, and (c) imposing a voltage potential between said rectifier metal and said second cathodic metal and raising said voltage to about 240 to about 260 volts within about 1 to about 60 seconds, and thereafter raising the voltage to about 380 to about 420 volts within about 1 to about 20 minutes, with visible sparking, until the desired coating thickness is deposited on said rectifier metal.

2. A method as in claim 1 wherein said rectifier metal is aluminum or aluminum alloy.

3. A method as in claim 2 wherein said cathodic metal is iron.

4. A method as in claim 1 wherein said rectifier metal is aluminum.

5. A method as in claim 3 wherein said cathodic metal is iron.

6. A method as in claim 1 wherein said cathodic metal is iron

7. A method as in claim 1, 2, 3, 4, 5 or 6 wherein said electrolytic bath further comprises an alkali metal hydroxide and wherein the pH of the electrolytic bath is from about 11.2 to about 11.8.

8. A method of coating a rectifier metal selected from the group consisting of aluminum, tantalum, magnesium and mutual alloys thereof, and alloys of aluminum with copper or zinc, to produce hard, smooth, adherent, uniform and corrosion-resistant coating of tungsten silicate, said method comprising:

(a) immersing said rectifier metal in an electrolytic bath comprising water, silicotungstic acid, alkali metal acetate, hydrogen fluoride, hydrogen peroxide and potassium silicate.

(b) immersing a second metal in said electrolytic bath, said second metal being cathodic relative to said rectifier metal when a voltage potential is applied between said metals, and (c) imposing a voltage potential between said rectifier metal and said cathodic metal and raising said voltage to about 240 to about 260 volts within about 1 to about 60 seconds, and thereafter raising the voltage to about 380 to about 420 volts within about 1 to about 20 minutes, with visible sparking, until the desired coating thickness is deposited on said rectifier metal.

9. A method as in claim 8 wherein said rectifier metal is aluminum or aluminum alloy.

10. A method as in claim 9 wherein said cathodic metal is iron.

11. A method as in claim 8 wherein said rectifier metal is aluminum.

12. A method as in claim 11 wherein said cathodic metal is iron.

13. A method as in claim 8 wherein said cathodic metal is iron.

14. A method as in claim 8, 9, 11, 10, or 12 wherein said electrolytic bath further comprises an alkali metal hydroxide and wherein the pH of the electrolytic bath is from about 11.2 to about 11.8.

* * * * *